United States Patent [19]

Olson

[11] Patent Number: 4,958,567

[45] Date of Patent: Sep. 25, 1990

[54] TRAINING CARTRIDGE WITH IMPROVED CASE FOR FIXING PROPELLANT POSITION IN POWDER CHAMBER

[75] Inventor: Richard H. Olson, Florissant, Mo.

[73] Assignee: Olin Corporation, Stamford, Conn.

[21] Appl. No.: 335,330

[22] Filed: Apr. 10, 1989

[51] Int. Cl.[5] ..... F42B 8/02

[52] U.S. Cl. ..... 102/444; 102/447; 102/529

[58] Field of Search ..... 102/430, 444, 446, 447, 102/529

[56] References Cited

U.S. PATENT DOCUMENTS

| | | | |
|---|---|---|---|
| 3,935,816 | 2/1976 | Boquette, Jr. | 102/444 |
| 4,508,036 | 4/1985 | Jensen et al. | 102/444 |
| 4,546,704 | 10/1985 | Ballreich et al. | 102/444 |
| 4,719,859 | 1/1988 | Ballreich et al. | 102/444 |
| 4,726,296 | 2/1988 | Leshner et al. | 102/467 |

OTHER PUBLICATIONS

Dynamit Nobel, Manoeuvre and Training Ammunition, pp. 1–15.

*Primary Examiner*—Charles T. Jordan
*Assistant Examiner*—Richard W. Wendtland
*Attorney, Agent, or Firm*—Bruce E. Burdick; John R. Wahl

[57] ABSTRACT

An improved training cartridge has a plastic case skeletonized at its leading portion and defining a powder chamber at its trailing portion closed by an integral forward wall. The location of the wall is preselected to tailor the internal volume of the powder chamber to substantially equal that of the quantity of propellant charge employed by the cartridge so as to retain the charge in a fixed position in the chamber adjacent the primer. The configuration can either include a plastic bullet for training with projectiles having limited (reduced) range, or be made without a bullet, for those training exercises requiring blanks.

19 Claims, 1 Drawing Sheet

TRAINING CARTRIDGE WITH IMPROVED CASE FOR FIXING PROPELLANT POSITION IN POWDER CHAMBER

The present invention generally relates to training cartridges and, more particularly, is concerned with those having an improved plastic case for retaining the propellant charge in a fixed position in a powder chamber adjacent to a primer. "Training cartridges" include configurations that employ plastic bullets for training with projectiles having limited (reduced) range. Training cartridges also include configurations which have no bullets whatsoever. They are called "blanks". This invention involves both types-those with plastic bullets, and blanks.

Training cartridges are known having a one-piece plastic bullet and case connected to a metal base. The plastic bullet can either be a solid or dummy (hollow) projectile extending from the forward end of the plastic case, merging with the mouth of the case at a preset breaking region. A propellant charge is housed in a powder chamber defined by the plastic case forwardly of the metal base. A primer is secured to the base for effecting ignition of the propellant charge located in powder chamber of the case.

Representative prior art disclosing training cartridges and a related ammunition cartridge are exemplified by U.S. Pat. No. to Jensen et al (4,508,036), Ballreich et al (4,546,704, Ballreich et al (4,719,859) and Leshner et al (4,726,296.

Upon firing, the solid plastic bullet of the training cartridge separates from the plastic cartridge case and leaves the barrel at a very high initial velocity. The plastic bullet develops this high initial velocity, amounting to much more than the Velocity of live ammunition, by virtue of its very low weight, being much less than the weight of live ammunition.

Owing to this high initial velocity, the first part of the ascending branch of the bullet's trajectory is extremely flat and thus provides the preconditions for accuracy in the training range. On the other hand, owing to its low sectional density, the light plastic bullet very rapidly loses its kinetic energy as it continues its flight. For such reason, the maximum range of plastic bullets remains far below the range covered by live bullets.

A serious drawback is presented by training cartridges not having a method of fixedly positioning the propellant with respect to the primer. Due to loading of a small volume of propellant charge into the much larger volume powder chamber of conventional cartridge cases there is a wide range of positions the propellant can assume in the chamber at time of firing depending, for instance, on the elevation or recoil of the gun. The training cartridge thus frequently exhibits non-uniform ballistic performance. In order to overcome this drawback, the above-cited U.S. Pat. No. 4,719,859 discloses the use of a separate cup shaped closure element at the forward end of the powder chamber to retain the propellant in a fixed position in the chamber adjacent the primer. Another design uses an "inner case" for the same reason. However, these solutions, while eliminating the above-cited drawback, undesirably increase the cost and complexity of assembly of the training cartridge.

Consequently, a need still exists for a simple practical approach to restraining shifting of the propellant charge during gun movement to different firing elevations for improvement of the uniformity of the ballistic performance of the training cartridge.

The present invention provides an improved training cartridge having a construction designed to satisfy the aforementioned needs. The basic improvement of the present invention relates to an improved plastic case for the training cartridge.

In accordance with the present invention, the improved plastic case has a skeletonized configuration at its leading portion and an integral transversely-extending forward closure wall closing a forward end of its powder chamber defined in its trailing portion. The location of the forward wall is preselected to tailor the internal volume of the powder chamber to generally equal that of the quantity of propellant charge employed by the cartridge so as to retain the charge in a fixed position in the chamber adjacent the primer.

Thus, in the improved plastic case, the propellant is similarly fixedly positioned at the primer as accomplished in the above-cited patent. However, no extra components requiring separate assembly steps are necessary to achieve the containment. Instead, the closure wall can be fabricated, such as by injection molding, simultaneously with fabrication of the rest of the improved one-piece bullet and case of the cartridge.

These and other features and advantages of the present invention will become apparent to those skilled in the art upon a reading of the following detailed description when taken in conjunction with the drawings wherein there is shown and described an illustrative embodiment of the invention.

In the course of the following detailed description, reference will be made to the attached drawings in which.

Figure 1:
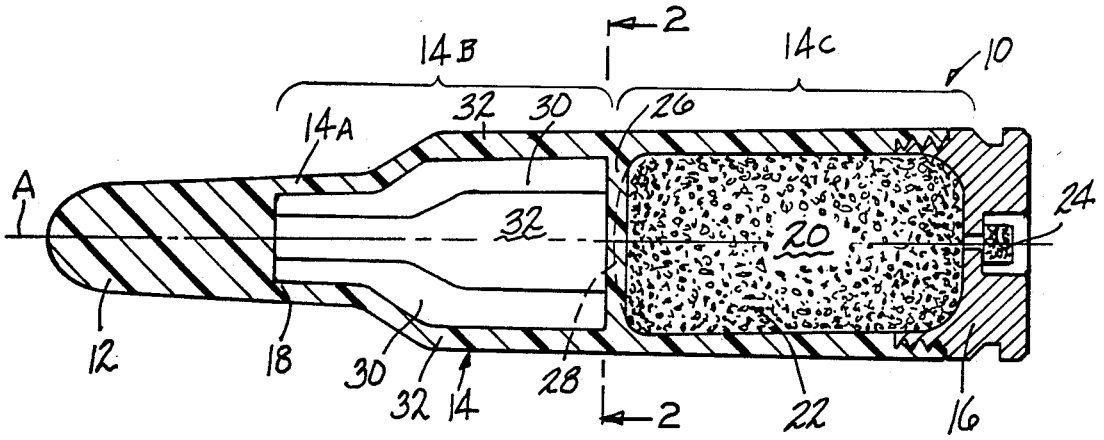
FIG. 1 is a longitudinal axial sectional view of a training cartridge having an improved construction in accordance with the present invention.
Figure 4:
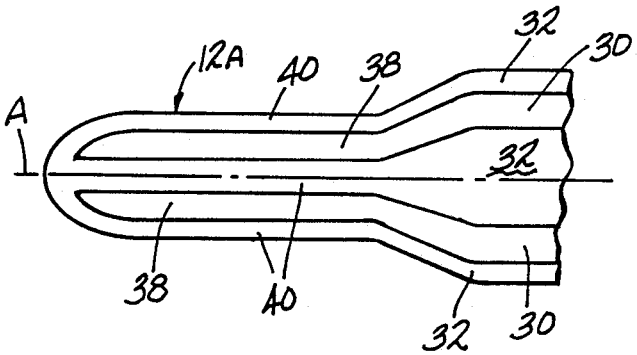
FIG. 4 is a fragmentary axial view of the cartridge of FIG. 1 showing an alternative construction of the forward portion thereof for use in blank cartridges in accordance with the present invention.

Referring now to the drawings, and particularly to FIG. 1, there is shown an improved training cartridge, generally designated by the numeral 10, constructed in accordance with the present invention. Basically, the improved training cartridge 10 includes an improved one-piece plastic bullet 12 and case 14 connected to a metal or plastic base 16. The bullet 12 and base 16 are respectively located at the front and rear of the cartridge 10 and the case 14 is located at the middle thereof. The plastic bullet 12 can either be a solid projectile as illustrated in FIG. 1 that is intended to exit the barrel, or dummy (blank) simulated projectile 12A as shown in FIG. 4 that remains attached to the case and is ejected from the gun with it. Referring to the reduced range training ammunition shown in FIG. 1, the bullet 12 extends axially and forwardly from the forward end of the plastic case 14, merging with the mouth 14A of the case 14 at a preset breaking or weakened region 18 which facilitates bullet separation upon firing of the cartridge 10. By way of example, the weakened region 18 can be defined by internal or external notches (not shown) to control breakaway.

Further, the plastic case 14 of the improved training cartridge 10 defines a powder chamber 20 extending forwardly of the base 16. A propellant charge 22 is housed in the powder chamber 20. A primer 24 is secured to the base 16 for effecting ignition of the propellant charge 22. The plastic case 14 is connected to the base 16 in any suitable manner, such as by a snap-in fitted connection or a threaded connection.

The non-uniform ballistics performance problem resulting from shifting of the propellant charge position within the powder chamber of the prior art cartridge stems from the incorporation of a powder chamber having considerably larger volume than the quantity of propellant charge utilized in the training cartridge. The improved training cartridge 10 in accordance with the present invention overcomes this problem without resorting to the use of a separate internal container as in the afore-cited U.S. Pat. No. 4,719,859.

Basically, the improvement incorporated in the improved training cartridge 10 of the present invention relates to the improved plastic case 14. The improved plastic case 14 has a skeletonized form at its leading portion 14B and an integral transversely-extending rupturable forward closure wall 26 at a forward end of its trailing portion 14C which closes the forward end of the powder chamber 20. The location of the forward wall 26 is preselected to tailor the internal volume of the powder chamber 20 to be substantially equal to that of the quantity of propellant charge 22 employed by the cartridge 10 so as to retain the charge 22 in a fixed position in the chamber 20 adjacent the primer 24. Thus, the propellant 22 is similarly fixedly positioned at the primer 24 as accomplished in the above-cited patent, but use of an extra component requiring separate assembly is not necessary to achieve the containment.

More particularly, as seen in FIG. 1, the integrally-connected leading and trailing portions 14B and 14C of the middle plastic case 14 are tandemly arranged. The trailing case portion 14C is in the form of a cylindrical wall connected at its rearward end to the base 16. The cylindrical wall 14C of the case 14 in conjunction with the base 16 defines the powder chamber 20 closed at its rearward end and extending forwardly of the base for housing the propellant charge 22. The leading case portion 14B is integrally connected to the bullet 12 so as to define the one-piece construction therewith.

For closing the powder chamber 20 at its forward end, the rupturable closure wall 26 is integrally connected to the case 14 at the location of merger of the trailing and leading portions 14C and 14B thereof. The closure wall 26 extends transversely across the case 14. As mentioned above, the location of the closure wall 26 is specifically preselected to tailor the internal volume of the powder chamber 20 to generally match or equal that of the quantity of propellant charge 22 so as to retain the propellant charge 22 in a fixed position in the powder chamber 20 adjacent the base 16 and primer 24, regardless of the elevation of the gun receiving and firing the training cartridge 10.

The closure wall 26 has weakened portions 28 therein for allowing rupture of the wall in response to ignition and explosion of the propellant charge 22 in the powder chamber 20. The weakened portions 28 can be defined by a plurality of break-through slots formed in the wall.

Figure 3:
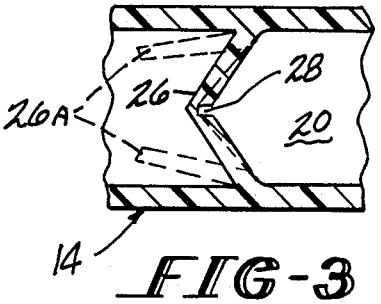
FIG. 3 is a fragmentary axial sectional view of the cartridge of Fig. 1 showing an alternative configuration of a forward closure wall of the powder chamber in the cartridge.

FIG. 3 illustrates a closure wall 26 having an alternative configuration. As shown, the wall 26 has a forward-projecting pyramid shape. The closed condition of the wall 26 is shown in solid line form and the ruptured condition in broken line form (labeled 26A).

Figure 2:
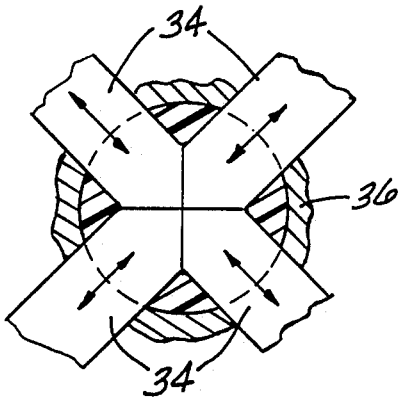
FIG. 2 is a cross-sectional view taken along line 22 of FIG. 1, showing forming of the skeletonized case with retractable mold tooling. Although four ribs and mold tools are shown, three, five, or other quantities are viable alternates.

As briefly mentioned above, the leading portion 14B of the case 14 has a skeletonized configuration. The skeletonized configuration of the case 14 is defined by a series of circumferentially-spaced alternating empty slots 30 and elongated solid ribs 32 integrally connected at a forward end to the bullet 12 and at a rearward end to the trailing portion 14C of the case 14. As seen in FIGS. 1 and 2, the solid ribs 32 are spaced radially outward from a longitudinal axis A of the case 14 and spaced apart circumferentially from one another about the axis A.

FIG. 2 shows by way of one example how the ribs 32 can be formed by injection molding. Four tools 34 can be brought together in a cylindrical mold 36 from four radial directions displaced about ninety degrees from one to the next. The inner ends of the tools 34 are configured to mate in closed relation and define a solid face providing one side of a transverse mold cavity for forming the closure wall 26. The other side of the transverse mold cavity as well as an outer tubular mold cavity for forming the cylindrical wall 14C of the case are defined by a solid cylindrical punch (not shown) which would also be inserted into the cylindrical mold.

As seen in FIG. 1, the bullet 12 is a solid projectile. However, for "blank" type training cartridges it can also be in the form of dummy projectile 12A, as seen in FIG. 4, having the skeletonized configuration of the case 14, or, in other words being composed of empty slots 38 and solid ribs 40 which are extensions of the case slots 30 and solid ribs 32. The hollow nose of the dummy bullet 12A can have grooves which split open or alternatively the slots 38 could allow venting of the propellant gases without the necessity of the nose fracturing. The cartridge profile generated by all designs shown is sufficient to provide retention in cartridge feeding belts, and subsequent feeding into the firing chamber of the weapon.

Figure 5:
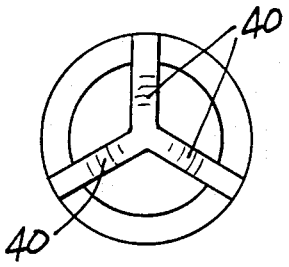
FIG. 5 is a frontal view of an alternate construction using solid ribs meeting at the center of the forward end of the case instead of the hollow skeletonized construction. Depending on whether the ribs extend over the area defined as 14B in FIG. 1, or to the tip of the bullet shape in FIG. 4 (left most point), this alternate could be used with plastic bullets, or blanks.

An alternative configuration of the case and bullet is shown in FIG. 5. The solid case and bullet ribs 32 and 40 extend radially in flute-like fashion relative to the longitudinal axis A of the case 14 and merge integrally together at the location of the axis.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely a preferred or exemplary embodiment thereof.

What is claimed is:

1. A training cartridge, comprising:

(a) a front bullet;

(b) a rear base for mounting a primer being operable for effecting ignition of a propellant charge;

(c) a middle case having tandemly-arranged and integrally connected leading and trailing portions;

(d) said trailing portion of said case being in the form of a cylindrical wall connected at its rearward end to said base and therewith defining a powder chamber closed at its rearward end and extending forwardly of said base for housing the propellant charge;

(e) said leading portion of said case integrally connected to said bullet so as to have a one-piece construction therewith; and (f) a rupturable closure wall integrally connected to said case at the location of merger of said trailing and leading portions thereof, said wall extending transversely across said case for closing a forward end of said powder chamber, said location of said closure wall being preselected to tailor the internal volume of said powder chamber to generally equal that of the quantity of said propellant charge so as to retain said propellant charge in a fixed position in said powder chamber adjacent said base regardless of the elevation of said training cartridge.

2. The training cartridge as recited in claim 1, wherein said leading portion of said case has a skeletonized configuration.

3. The training cartridge as recited in claim 2, wherein said skeletonized configuration of said case leading portion is defined by a series of circumferentially-spaced alternating empty slots and elongated solid ribs integrally connected at a forward end to said bullet.

4. The training cartridge as recited in claim 3, wherein said solid ribs extend radially relative to a longitudinal axis of said case and merge integrally together at the location of said axis.

5. The training cartridge as recited in claim 3, wherein said solid ribs are spaced radially outward from a longitudinal axis of said case and spaced apart circumferentially from one another about said axis.

6. The training cartridge as recited in claim 2, wherein said bullet is a hollow dummy projectile having said skeletonized configuration of said case.

7. The training cartridge as recited in claim 1, wherein said bullet is a solid projectile.

8. The training cartridge as recited in claim 1, wherein said bullet is a hollow dummy projectile.

9. The training cartridge as recited in claim 1, wherein said bullet extends axially and forwardly from a forward end of said case and has a preset weakened region defined thereon which facilitates bullet separation from said case upon firing of said cartridge.

10. The training cartridge as recited in claim 1, wherein said closure wall has weakened portions therein for allowing rupture of said wall in response to ignition and explosion of said propellant charge.

11. The training cartridge as recited in claim 10, wherein said weakened portions are defined by a plurality of break-through slots formed in said wall.

12. A training cartridge, comprising:

(a) a propellant charge;

(b) a primer being operable for effecting ignition of said propellant charge;

(c) a base for mounting said primer;

(d) a one-piece plastic bullet and case connected to said base, said case defining a powder chamber extending forwardly of said base for housing said propellant charge;

(e) said case having a trailing portion in the form of a cylindrical wall which defines said powder chamber and is connected at a rearward end of said case to said base;

(f) said case also having a leading portion with a skeletonized configuration defined by a series of circumferentially-spaced alternating empty slots and elongated solid ribs integrally connected at a forward end of said case to said bullet, said leading and trailing portions of said case merging integrally with one another at an intermediate location between said forward and rearward ends of said case; and (g) a closure wall integrally connected to said case at said intermediate location between said forward and rearward ends thereof and extending transversely across said case for closing a forward end of said powder chamber, said intermediate location of said closure wall being preselected to tailor the internal volume of said powder chamber to generally equal that of the quantity of said propellant charge so as to retain said propellant charge in a fixed position in said powder chamber adjacent said primer regardless of the elevation of said training cartridge.

13. The training cartridge as recited in claim 12, wherein said solid ribs extend radially relative to a longitudinal axis of said case and merge integrally together at the location of said axis.

14. The training cartridge as recited in claim 12, wherein said solid ribs are spaced radially outward from a longitudinal axis of said case and spaced apart circumferentially from one another about said axis.

15. The training cartridge as recited in claim 12, wherein said bullet is a solid projectile.

16. The training cartridge as recited in claim 12, wherein said bullet is a hollow dummy projectile having said skeletonized configuration of said case.

17. The training cartridge as recited in claim 12, wherein said bullet extends axially and forwardly from a forward end of said case, merging with a solid ribs of said case and having a preset weakened region defined thereon which facilitates bullet separation from said case upon firing of said cartridge.

18. The training cartridge as recited in claim 12, wherein said closure wall has weakened portions therein for allowing rupture of said wall in response to ignition and explosion of said propellant charge.

19. The training cartridge as recited in claim 18, wherein said weakened portions are defined by a plurality of break-through slots formed in said wall.

* * * * *